United States Patent [19]

Medovar et al.

[11] 4,395,771

[45] Jul. 26, 1983

[54] METHOD AND APPARATUS FOR CONTROLLING PROCESS OF CASTING THIN WALLED INGOTS USING ELECTROSLAG MELTING PROCESS

[76] Inventors: Boris I. Medovar, ulitsa Anri Barbjusa, 22/26, kv. 109; Evgeny D. Gladky, ulitsa E. Potie, 9, kv. 89; Oleg P. Bondarenko, ulitsa Kreschatik, 15, kv. 36; Leonty V. Chekotilo, ulitsa Anri Barbjusa, 22/26, kv. 64; Valery I. Zayats, ulitsa E. Potie, 9, kv. 89; Sergei P. Egorov, ulitsa Nevskaya, 34, kv. 1; Jury A. Skosnyagin, ulitsa Ilicha, 10/5, kv. 4, all of Kiev, U.S.S.R.

[21] Appl. No.: 244,132

[22] PCT Filed: Nov. 19, 1979

[86] PCT No.: PCT/SU79/00115

§ 371 Date: Sep. 30, 1980

§ 102(e) Date: Sep. 25, 1980

[87] PCT Pub. No.: WO80/01573

PCT Pub. Date: Aug. 7, 1980

[30] Foreign Application Priority Data

Jan. 31, 1979 [SU] U.S.S.R. ..... 2712297

[51] Int. Cl.[3] ..... H05B 3/60; H05B 7/148

[52] U.S. Cl. ..... 373/49; 373/104

[58] Field of Search ..... 164/470, 497, 509, 515; 13/9 ES, 9, 13; 373/42, 47, 49, 104

[56] References Cited

U.S. PATENT DOCUMENTS

| | | | |
|---|---|---|---|
| 3,890,457 | 6/1975 | Fain | 13/9 ES |
| 4,194,078 | 3/1980 | Thomas | 13/9 ES |
| 4,273,948 | 6/1981 | Masucci | 13/9 ES |

FOREIGN PATENT DOCUMENTS 1960936 of 0000 Fed. Rep. of Germany .

OTHER PUBLICATIONS

Problems of Special Electrometallurgy, Issue 5, 1976 Kiev, et al, Automatic Control System of Melting in the Electroslag Remelting Units, p. 711–Steel, No. 8, 1973.

*Primary Examiner*—Roy N. Envall, Jr.

*Attorney, Agent, or Firm*—Lilling & Greenspan

[57] ABSTRACT

The method consists of maintaining constant the magnitude of the interelectrode gap. For this purpose a melting current is measured and averaged for a constant predetermined time interval, whereafter a derivative of an averaged value of the melting current is determined, an amplitude of oscillations of the melting current relative to the averaged values of the melting current is detected, and a derivative of the rectified amplitude of oscillations of this current is determined. Then the obtained data are compared, and from the results of this comparison the melting current is controlled in such manner that said values are reduced to zero.

The apparatus for controlling the process of casting thin walled ingots using the electroslag melting method comprises a melting current pick-up having an output connected to the inputs of a comparison unit and of a determination unit for determining an averaged value of the melting current. The output of the determination unit is connected via a detecting unit for detecting an amplitude of oscillations of the melting current and via a first derivative unit for determining a derivative of this detected amplitude to a third input of a logic unit. The output of the detecting unit is connected to a second input of the unit whose first input is connected via a second derivative unit 13 for determining a derivative of the averaged value of the melting current to the output of the determination unit. The output of the logic unit is connected via the comparison unit to the input of the control unit.

3 Claims, 3 Drawing Figures

METHOD AND APPARATUS FOR CONTROLLING PROCESS OF CASTING THIN WALLED INGOTS USING ELECTROSLAG MELTING PROCESS

FIELD OF THE INVENTION

The present invention relates to electroslag melting, and more particularly to methods and apparatus for controlling a process of casting thin walled ingots using the electroslag melting process.

The method of the invention and the apparatus for practicing the same can be utilized in the manufacture of thin ingots-slabs, thin hollow ingots, and other thin walled products.

DESCRIPTION OF THE ART

Known in the art is a method of controlling the electroslag melting process by the resistance of the slab bath within the interelectrode gap, and the speed of electrode melting. The resistance of the slag bath in this method is controlled by varying the magnitude of the interelectrode gap so as to reduce to zero the difference between the voltage drop across the slag bath and the voltage drop across the resistance through which the current is flowing from the furnace transformer.

It has been found that the location of an electrode within the slag bath (its immersion) is determined by the resistance of the interelectrode gap which resistance is in linear dependence upon the magnitude of this gap within the limits of working draughts. To obtain a homogeneous ingot, the magnitude of the interelectrode gap should be constant in the process of electroslag melting, and must be equal to a predetermined process value.

There are also known a method and an apparatus to control the process of casting the ingots using the process of electroslag melting (Problemy spetsialnoj electrometallurgii-Problems of special electrometallurgy, issue 5, 1976, Kiev, B. E. Paton et al., Skhemy pitanija i upravlenija bifilljarnoj pechi ЭШП -40 (УШ -105)- Feeding and control circuits for ЭШП -40 (УШ -105) bifilar furnace, pp. 3–6, particularly 5–6), wherein the magnitude of the interelectrode gap is maintained constant, which is accomplished by measuring the resistance of the slag bath within the interelectrode gap, determining variation of said resistance from the predetermined value, and varying the power supplied to the slag bath depending upon said variation.

The apparatus for practicing the above method comprises a unit for measuring the resistance of the interelectrode gap, the output of said unit being connected to a unit for comparing the current value of the resistance against the predetermined value. The output of said unit for comparing is connected to a unit for forming a control action, the latter having its output connected to a drive for moving the consumable electrode.

In the prior art apparatus maintaining the magnitude of the interelectrode gap constant is effected by continuously measuring said gap in a unit for measuring said resistance. The output signal of this unit, corresponding to the value of the actual resistance, is fed into the unit for comparing wherein it is compared against the signal corresponding to the value of the predetermined resistance. Error signals are fed into the unit for forming a control action which governs the drive for moving the electrode.

It is well known that in the process of electroslag melting, stability of the melting current is determined by the location of an electrode within the slag bath (its draught).

Experience has proved that for a shallow slag bath, e.g. in melting thin walled ingots within an enlarged mould, the region of stable values of the melting current becomes narrower and is equal to several millimeters.

In this case controlling the process, as above described, does not ensure the location of the electrode within the region of stable current values. Current variations beyond this region result in an instability of operation of the control system (system wobbling) which results in a poor surface of the product being melted (corrugations, contractions) thereby considerably detriorating surface quality and structure of the ingots being cast.

SUMMARY OF THE INVENTION

The invention is directed to a method and an apparatus for controlling a process of casting thin walled ingots by applying the method of electroslag melting wherein by analyzing the time characteristic of the melting current it is possible to improve the quality of the surface and the structure of these ingots.

The object set forth is attained by a method of controlling the process of casting thin walled ingots using a method of electroslag melting by maintaining the magnitude of the interelectrode gap constant. According to the invention, during the process of maintaining the magnitude of the interelectrode gap constant, there are carried out the steps of measuring and averaging the melting current for a constant predetermined time interval; determining the derivative of the averaged value of the melting current; detecting the amplitude of oscillations of the melting current relative to the averaged current values, determining the derivative of the detected amplitude of oscillations of the melting current, comparing obtained values of a derivative of the averaged melting current, of the rectified amplitude of the melting current and of the derivative of the detected amplitude of the oscillations of the melting current; and regulating the melting current from the comparison results so as to reduce said values to zero.

The object set is further attained by an apparatus, for practicing the method of controlling a process of casting thin walled ingots using the method of electroslag melting, comprising a drive for displacing a consumable electrode which provides for maintaining the magnitude of the interelectrode gap constant and is connected to the output of a control unit for forming a control action; a melting current pick-up includes outputs connected to the inputs of a comparison unit and to those of a determination unit for determining an averaged melting current for a constant time interval. The output of the determination unit is connected via a detecting unit, for detecting an amplitude of oscillations of the melting current relative to averaged values of the current, and via a derivative unit for determining a derivative of the detected amplitude of oscillations of the melting current, to a third input of a logic unit. A second input of the logic unit is connected to the output of the detecting unit for detecting an amplitude of oscillations of the melting current relative to averaged values, and a first input of said logic unit is connected via a derivative unit for determining a derivative of an averaged value of the melting current to the output of the unit determination for determining an averaged value of the melting current for a constant time interval. The output of the logic unit is connected to the other inputs of the comparison unit. The output of the comparison unit is connected to the input of the control unit for forming a control action.

It is desirable that the logic unit contain seven AND-circuits, two OR-circuits, YES-circuits, NOT-circuits, inverters and a master clock. The output of the derivative unit for determining a derivative of an averaged value of the melting current, is connected via the YES-circuits to first inputs of a first and a fourth AND-circuits, via the NOT-circuits to first inputs of a second, a sixth, and a seventh AND-circuits, and via the inverter and a YES-circuit to first inputs of a third and a fifth AND-circuits. The output of the detecting unit, for detecting an amplitude of oscillations of the melting current relative to averaged current values is connected via YES-circuits to second inputs of the first six AND-circuits, and via a NOT-circuit to the second input of the seventh circuit. The output of the derivative unit for determining a derivative of a detected amplitude of oscillations of the melting current, is connected via YES-circuits to third inputs of the first and the fifth AND-circuits, via NOT-circuits to third inputs of the second, the sixth, and the seventh AND-circuits, and via the inverter and a YES-circuit to third inputs of the third and the fourth AND-circuits. The output of the first AND-circuit is connected to the fourth input of the second AND-circuit, and the output of the fifth AND-circuit is connected to the fourth input of the sixth AND-circuit. The outputs of the first, the second, and the third AND-circuits are connected via the first OR-circuit to the first input of the master clock; the second input of said master clock is connected via the second OR-circuit to the outputs of the fourth; the fifth, and the sixth AND-circuits, the third input of said master clock is connected to the output of the seventh AND-circuit and, the output of said master clock is connected to the input of the comparison unit for comparing.

Thus, the above described method and apparatus allow thin walled ingots to be produced; and these ingots exhibit high quality of the surface and of the ingot structure.

BRIEF DESCRIPTION OF THE DRAWINGS

The invention is further explained in more detail in terms of specific embodiments thereof with reference to the accompanying drawings, in which.

DETAILED DESCRIPTION OF THE INVENTION

Figure 1:
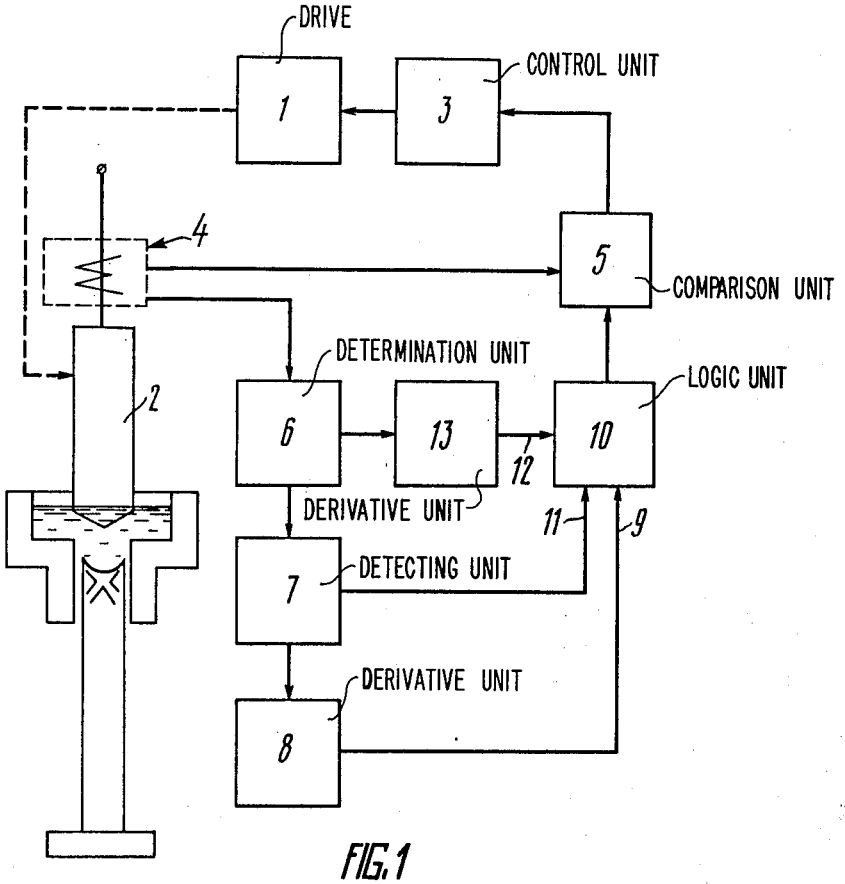
FIG. 1 shows a block diagram of the apparatus of the invention.
Figure 3:
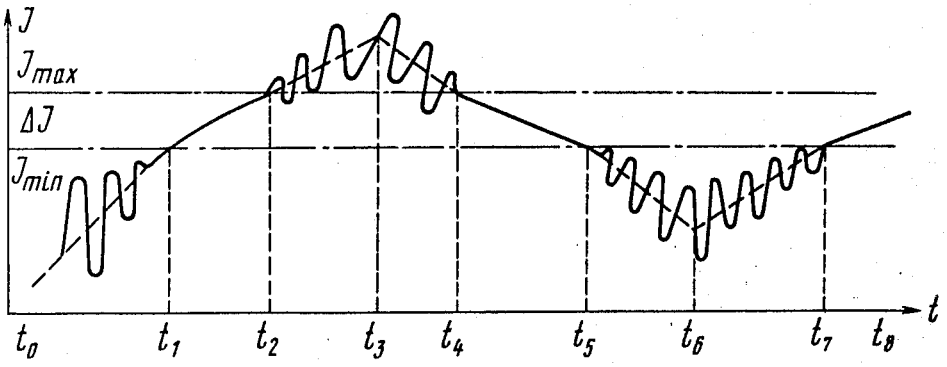
FIG. 3 is a graph, showing the time dependence of the melting current obtained for an embodiment of the method of the invention.

A method of controlling a process for melting thin-walled ingots using the electroslag melting process consists of in the process of electroslag melting, maintaining constant the interelectrode gap. For this reason measuring and averaging the melting current for a predetermined constant time interval are carried out. Following this, a derivative of this averaged value of the melting current is determined, the amplitude of oscillations of the melting current relative to averaged values thereof is detected, and a derivative of the rectified amplitude of oscillations of the melting current is determined. The thus obtained values of the derivative of the averaged melting current, of the detected amplitude of oscillations of the current, and of the derivative of the detected amplitude of oscillations of the melting current are compared, and, from the results of the comparison, the melting current is controlled to reduce these values to zero.

It should be noted that averaging the melting current for the predetermined time interval is carried out in accordance with the principle of averages as follows:

$$\Delta t = t_n - t_0 I'_c = \frac{\sum_{c}^{n} I_a}{n}$$

$$\Delta t = t_{n+1} - t_1 I'_1 = \frac{\sum_{1}^{n+1} I_a}{n}$$

$$\vdots$$

$$\Delta t = t_{n+k} - t_k I'_k = \frac{\sum_{k}^{n+k} I_k}{n}$$

where n is the number of measurements for the time interval t;

$I_a$ is the amplitude value of the melting current, registered by the measuring device; and I' is the averaged value of the melting current for the time interval $\Delta t$.

Thus, stability of the number of measurements within the predetermined time interval is obtained.

Determination of a derivative of the averaged value of the current is carried out to establish the presence and the direction of variations in the electrode draught. Thus, $dI'/dt>0$ evidences that the draught is increased (the interelectrode gap is decreased), while $dI'/dt<0$ indicates a decrease in the draught (the interelectrode gap increases), and $dI'/dt=0$ shows that the interelectrode gap is constant.

Detection of the amplitude of oscillations of the melting current relative to averaged values of this current is accomplished to determine the presence of the current oscillations. If the value of this detected amplitude of oscillations of the melting current (I'a) is equal to zero, this is evidence of the fact that there take place current oscillations, while in the opposite case ($I'a \neq 0$) the oscillations are absent.

Determination of a derivative of the detected amplitude of oscillations of the melting current ($dI'_a/dt$) establish the character of the variation of the amplitude of oscillations (I'a) in terms of time, and, consequently, the electrode position relative to stable values of the current.

Thus, $dI'_a/dt<0$ evidences that the amplitude of oscillations of the melting current is decreasing and the electrode approaches the region of stable values of the current; $dI'_a/dt>0$ indicates that the amplitude of oscillations of the melting current is increasing and the electrode moves away from the region of the stable values of the current; $dI'_a/dt=0$ shows that the oscillations remain constant and the electrode is immovable relative to the region of stable currents.

Reduction of these values to zero by controlling the melting current maintains the value of the melting current within the region of stable values of the current, and consequently maintains the magnitude of the inter-electrode gap constant; in its turn, this allows the quality of the surface and the structure of the ingots being melted to be improved.

There is also proposed an apparatus for controlling the process of melting thin walled ingots using the electroslag melting method, said apparatus comprising a drive 1 (FIG. 1) for displacing a consumable electrode 2. The drive 1 is connected to a control unit 3 for forming a control action. The unit 3 monitors the operation of the drive 1. The described apparatus is provided, according to the invention, with a melting current pick-up 4. A current transformer is used as the pick-up 4. The output of the pick-up 4 is connected to inputs of a comparison unit 5 for comparing and of a determination unit 6 for determining an averaged value of the melting current. The unit 5 is designed for comparing a signal corresponding to the actual value of the melting current against a master signal.

The unit 6 is an integrator averaging a signal corresponding to the melting current for the predetermined constant time interval. The output of the unit 6 is connected via a detecting unit 7 for detecting an amplitude of oscillations of the melting current relative to averaged current values, and via a derivative unit 8, for determining a derivative of the detected amplitude of oscillations of the current, to a third input 9 of a logic unit 10.

A rectifier may be used as the detecting unit 7, and a differentiator may be used as the unit 8.

The output of the unit 7 is connected to a second input 11 of the unit 10, and the first input 12 of said unit is connected to the output of the unit 6 via a derivative unit 13 for determining a derivative of an averaged value of the melting current.

The output of the unit 10 is connected to the input of the unit 3 via the unit 5.

The logic unit 10 is designed for logic comparison of input values, and for generating a master signal in accordance with this comparison.

The logic unit 10, according to the invention (FIG. 2), comprises seven AND-circuits 14, 15, 16, 17, 18, 19 and 20, two OR-circuits 21 and 22, YES-circuits 23, NOT-circuits 24, inverters 25, and a master clock 26.

The YES circuits 23 are designed to separate signals having positive polarity. These circuits can be based either on diodes, or on relay components.

The inverters 25 are designed for changing the signal polarity to the opposite one and can be based either on diodes, or on transistors.

The output of the derivative unit 13, which is the first input of the unit 10, is connected via YES circuits 23 to the first inputs of the AND circuits 14 and NOT 17, via the circuits 24 to the first inputs of the AND circuits 15, 19, and 20, and via inverter 25 and circuit 23 to the first inputs of the circuits 16 and 18.

The output of the detecting unit 7 which is the second input 11 of the unit 10, is connected via the YES circuits 23 to the second inputs of the AND circuits 14, 15, 16, 17, 18 and 19, and via the NOT circuit 24 to the second input of the AND circuit 20.

The output of the derivative unit 8, which is the third input of the unit 10, is connected via the YES circuits 23 to the third inputs of the AND circuits 14 and 18, via the NOT circuits 24 to the third inputs of the AND circuits 15, 19, and 20, and via interters 25 and AND circuit 23 to the third inputs of the circuits 16 and 17.

The output of the AND circuit 14 is connected to the fourth input of the AND circuit 15, and the output of the AND circuit 18 is connected to the fourth input of the AND circuit 19. The outputs of the AND circuits 14, 15 and 16 are connected via the OR circuit 21 to the first input of the master clock 26. The second input of said master clock is connected via the OR circuit 22 to the outputs of the AND circuits 17, 18, and 19. The third input of the master clock 26 is connected to the output of the AND circuit 20, and the output thereof is connected to one of the inputs of the comparison unit 5.

The master clock 26 is a controlled constant voltage source whose output signal corresponds to the master signal for the melting current.

The described apparatus operates as follows.

During the process of melting the consumable electrode 2 (FIG.1) an electric signal, corresponding to the value of the melting current, is fed from the pick-up 4 into the comparison unit 5 and into the determination unit 6. Within the unit 6 there is effected sliding averaging of the value of the melting current for a certain predetermined time interval. A signal corresponding to the averaged value of the melting current is fed from the output of the unit 6 to the input of the derivative unit 13, where a derivative of the averaged value of the current in terms of time is determined. The output signal of the unit 6 is also fed to the input of the detecting unit 7, where the amplitude of oscillations of the melting current relative to the averaged value of the melting current is separated. From the output of the unit 7 the electric signal corresponding to the value of the separated amplitude of oscillations of the melting current is fed to the input of the derivative unit 8, where a derivative of the rectified amplitude of oscillations of the current in terms of time is determined.

A signal corresponding to the value and polarity of the derivative of the averaged value of the melting current in terms of time being fed from the output of the unit 13, a signal corresponding to the value of the rectified amplitude of oscillations of the melting current relative to the averaged value thereof being fed from the output of the unit 7, and a signal corresponding to the value and polarity of the derivative of the rectified amplitude of the current in terms of time being fed from the output of the unit 8 are supplied to the inputs of the logic unit 10.

The function of the logic unit is that, after having compared said values which had been supplied to the inputs thereof, this unit makes a decision on changing the melting current value.

The unit 10 operates as follows.

If the output signal of the unit 13, corresponding to the derivative of the averaged value of the melting current ($dI'_1/dt$) has a positive polarity, this signal is fed via the YES circuits 23 to the first inputs of the AND circuits 14 and 17. If this signal has the negative polarity, it is fed via the circuits 25 and 23 to the first inputs of the AND circuits 16 and 18. If this signal is equal to zero, it is fed via the NOT circuits 24 to the first inputs of the AND circuits 15, 19, and 20.

The output signal of the unit 7 corresponding to the rectified amplitude of oscillations of the melting circuit ($I'a$) is fed, if equal to zero, via the NOT circuit 24 to the second input of the AND circuit 20, and, if it is not equal to zero this signal is fed to the second inputs of the AND circuits 14, 15, 16, 17, 18, and 19 via YES circuits 23.

If the output signal of the unit 8, corresponding to the derivative of the detected amplitude of oscillations of the melting current ($dI'_a/dt$) has a positive polarity, it is fed via the YES circuits 23 to the third inputs of the AND circuits 14 and 18. If this signal is equal to zero, it is fed via the NOT circuits 24 to the third inputs of the AND circuits 15, 19, and 20. If the polarity of the output signal of the unit 13 is negative, this signal is fed via the inverter and YES circuits 25 and 23 to the third inputs of the AND circuits 16 and 17.

Since the output signals of the units 13, 7 and 8 carry information on a position of the electrode relative to the region of stable values, each of the AND circuits 14, 15, 16, 17, 18, 19, and 20 will operate at a certain draught of the electrode into the slag bath.

The circuit 14 operates with the following combination of signals: $dI'/dt>0; I'_a\neq 0; dI'_a/dt>0$. This means that the electrode, while being draught, moves away from the region of stable values.

The circuit 15 operates with the following combination of signals: $dI'/dt=0; I'_a\neq 0; dI'_a/dt=0$, i.e. when the electrode is located below the region of stable values.

The circuit 16 operates with the following combination of signals: $dI'/dt<0; I_a\neq 0; dI'_a/dt<0$, i.e. when the electrode, while being lifted, approaches the region of stable values.

The circuit 17 operates with the following combination of signals: $dI'/dt>0; I'_a\neq 0; dI'_a/dt<0$. This means that the electrode, while being draught, approaches the region of stable values.

The circuit 18 operates with the following combination of signals: $dI'/dt<0; I'_a\neq 0; dI'_a/dt>0$; i.e. when the electrode, while being lifted, moves away from the region of stable values.

The circuit 19 operates with the following combination of signals: $dI'/dt=0; I'_a\neq 0; dI'_a/dt=0$, i.e. when the electrode is above the region of stable values.

The circuit 20 operates with the following combination of signals: $dI'/dt\equiv 0; I'_a=0; dI'_a/dt=0$. This means that the electrode is within the region of stable values.

It can be seen from the above described that the circuits 15 and 19 must give different responses with the same combination of signals. For this reason, to obtain single-value identification of the situation (i.e. electrode behaviour), the circuits 15 and 19 operate only after their fourth input is supplied with the output signal from the output of the circuits 14 and 18 respectively.

The output signals of the AND-circuits 14, 15, and 16 are fed to the inputs of the OR circuit 21, while the output signals of the circuits 17, 18, and 19 are fed to the inputs of the OR circuit 22. The output signal of the OR circuit 21 being supplied to the first input of the master clock 26, is a command for lowering the level of the master signal.

The output signal of the OR circuit 22, being supplied to the second input of the master clock 26, is a command for increasing the level of the master signal. The output signal of the AND-circuit 20, being supplied to the third input of the master clock 26, is a command for fixing the level of the master signal.

Within the master clock 26 there occurs formation of a master signal in accordance with the fed signals. The output signal of the master clock 26, which is a specification into the loop controlling the current, is fed into the comparison unit 5 for comparing, where it is compared against the signal corresponding to the value of the melting current.

In accordance with the obtained error signal, the control unit 3 generates a control action supplied to the drive 1 for displacing the electrodes.

Thus, the apparatus of the invention makes it possible to stabilize automatically the magnitude of the interelectrode gap thereby improving the quality of surface and the structure of ingots.

Figure 2:
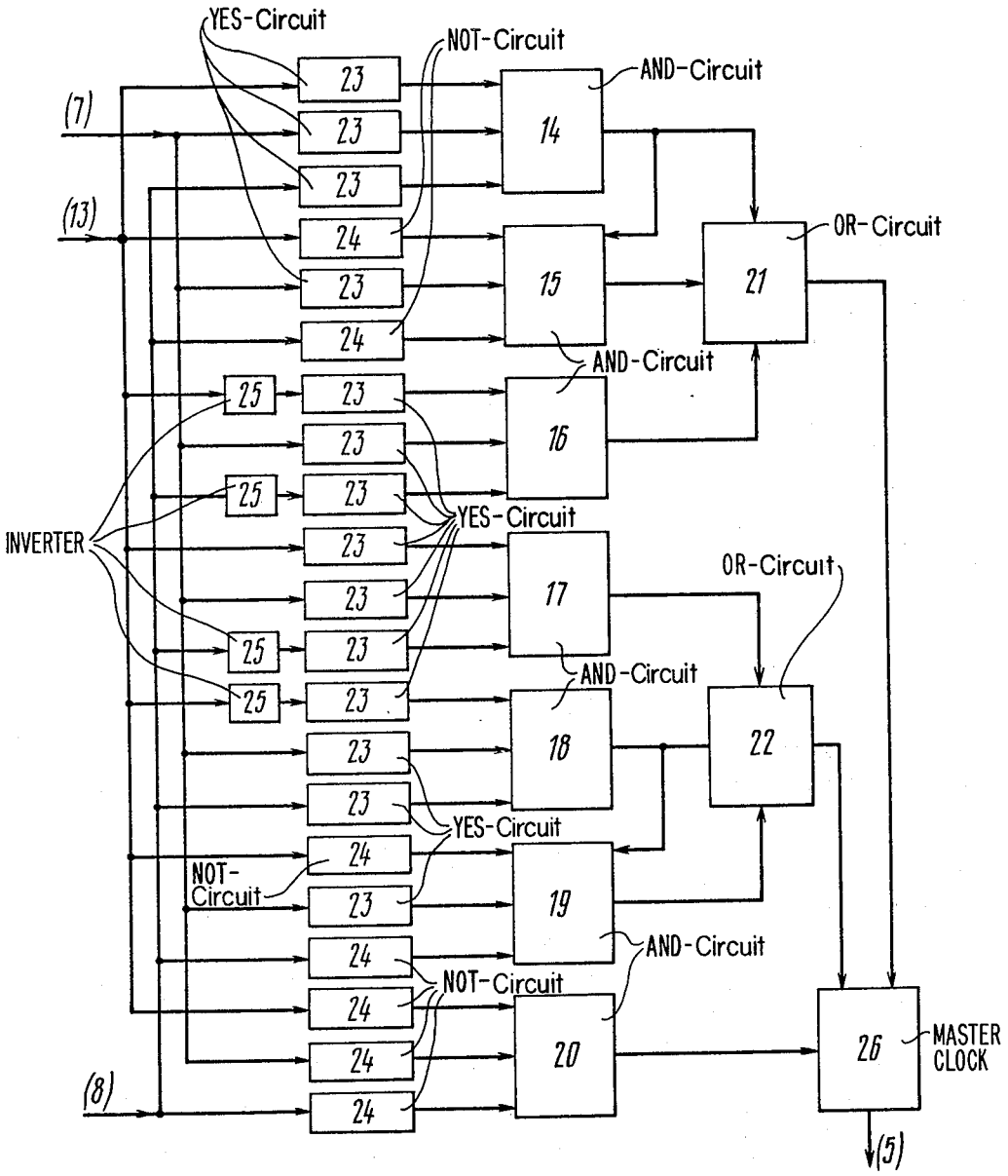
FIG. 2 shows a block diagram of the logic unit of the invention.

The table illustrates an embodiment of the method of the invention. Time dependence of the melting current for the given case is shown in FIG. 2. The height of the slag bath was about 40 mm.

TABLE

| | Information to unit IO | | | | |
|---|---|---|---|---|---|
| Time interval | from unit 13, $\frac{dI'}{dt}$ | from unit 7, $I'_a$ | from unit 8, $\frac{dI'_a}{dI}$ | Logic conclusion of unit IO on electrode location | Command to master clock 26 |
| 1 | 2 | 3 | 4 | 5 | 6 |
| Beginning of electrode melting $t_0$–$t_1$ | $\frac{dI}{dt}>0$ | $I'_a\neq 0$ | $\frac{dI'_a}{dt}<0$ | Electrode, while being draught, approaches to region of stable values of current | Increase specification (melting current) |
| $t_1$–$t_2$ | $\frac{dI}{dt}=0$ | $I'_a\neq 0$ | $\frac{dI'_a}{dt}=0$ | Electrode is within region of stable values of current | Fix specification |
| $t_2$–$t_3$ | $\frac{dI}{dt}>0$ | $I'_a\neq 0$ | $\frac{dI'_a}{dt}>0$ | Electrode, while being draught, moves away from region of stable values of current | Lower specification |
| $t_3$ | $\frac{dI}{dt}\ 0$ | $I'_a\neq 0$ | $\frac{dI'_a}{dt}=0$ | Electrode is below region of stable values of current | Lower specification |
| $t_3$–$t_4$ | $\frac{dI}{dt}<0$ | $I'_a\neq 0$ | $\frac{dI'_a}{dt}=0$ | Electrode, while being lifted, approaches to region of stable values of current | Continue to lower specification |
| $t_4$–$t_5$ | $\frac{dI}{dt}=0$ | $I'_a\neq 0$ | $\frac{dI'_a}{dt}=0$ | Electrode is within region of stable values of current | Fix specification |

TABLE-continued

| Time interval | Information to unit IO: from unit 13, $\frac{dI'}{dt}$ | from unit 7, $I'_a$ | from unit 8, $\frac{dI'_a}{dI}$ | Logic conclusion of unit IO on electrode location | Command to master clock 26 |
|---|---|---|---|---|---|
| 1 | 2 | 3 | 4 | 5 | 6 |
| $t_5$–$t_6$ | $\frac{dI}{dt} < 0$ | $I'_a \neq 0$ | $\frac{dI'_a}{dt} > 0$ | Electrode, while being lifted, moves away from region of stable values of current | Increase specification |
| $t_6$ | $\frac{dI}{dt} = 0$ | $I'_a \neq 0$ | $\frac{dI'_a}{dt} = 0$ | Electrode is above region of stable values of current | |
| $t_6$–$t_7$ | $\frac{dI}{dt} > 0$ | $I'_a \neq 0$ | $\frac{dI'_a}{dt} < 0$ | Electrode, while being draught, approaches to region of stable values of current | Continue to increase specification |
| $t_7$–$t_8$ | $\frac{dI}{dt} = 0$ | $I'_a = 0$ | $\frac{dI'_a}{dt} = 0$ | Electrode is within region of stable values of current | Fix specification |

INDUSTRIAL APPLICABILITY

The above described method and apparatus can be applied for manufacturing thin walled ingots such as thin ingots-slabs, thin hollow ingots etc.

What is claimed is:

1. A method of controlling a process of casting thin walled ingots using the electroslag melting method by maintaining a magnitude of an interelectrode gap constant, comprising the steps of, during the process of maintaining the magnitude of the interelectrode gap constant, measuring and averaging the melting current for a constant predetermined time interval; determining a derivative of the averaged value of the melting current; detecting an amplitude of oscillation of the melting current relative to the averaged values of the current; determining a derivative of the detected amplitude of oscillations of the melting current; comparing obtained values of the derivative of the averaged melting current, of the detected amplitude of oscillations of the melting current, and of the derivative of the detected amplitude of oscillations of the melting current; and, regulating the melting current from the results of said comparison so that said values are reduced to zero.

2. An apparatus for controlling a process of casting thin walled ingots using the electroslag melting method, comprising: a drive displacing a consumable electrode and maintaining the magnitude of the interelectrode gap constant; a control unit connected to said drive, forming a control action signal, and having an input; a melting current pick-up having outputs; a comparison unit having a first input connected to one of said outputs of said pick-up, a second input, and an output connected to said input of said control unit; a determination unit determining an averaged value of the melting current for a predetermined time interval, and having an input connected to one of said outputs of said pick-up and an output; a detecting unit detecting an amplitude of oscillations of the melting current relative to averaged values of the melting current, and having an input connected to said output of said determination unit and an output; a first derivative unit determining a derivative of the detected amplitude of oscillations of the melting current, and having an input connected to said output of said detecting unit and an output; a second derivative unit determining a derivative of the averaged value of the melting current, and having an input connected to said output of said determination unit and an output; and, a logic unit having inputs respectively connected to said outputs of said detecting unit, said first derivative unit and said second derivative unit, and an output connected to said second input of said comparison unit.

3. An apparatus as set forth in claim 2, wherein the logic unit comprises first, second, third, fourth, fifth, sixth, and seventh AND-circuits, first and second OR-circuits, YES-circuits, NOT-circuits, inverters, and a master clock; wherein the output of the second derivative unit is connected via YES-circuits to first inputs of said first and fourth AND circuits, via NOT-circuits to first inputs of said second, sixth and seventh AND-circuits, and via inverters and YES circuits to first inputs of the third and fifth AND-circuits; the output of the detecting unit is connected via YES-circuits to second inputs of the first, second, third, fourth, fifth and sixth AND-circuits and via a NOT-circuit to a second input of the seventh AND-circuit; the output of the first derivative unit is connected via YES-circuits to third inputs of the first and fifth AND-circuits, via NOT-circuits to third inputs of the second, sixth and seventh AND-circuits, and via inverters and YES-circuits to third inputs of the third and fourth AND-circuits; the output of the first AND-circuit is connected to a fourth input of the second AND-circuit, and the output of the fifth AND-circuit is connected to a fourth input of the sixth AND-circuit; outputs of the first, second and thirds AND-circuits are connected via the first OR-circuit to a first input of the master clock; a second input of said master clock is connected via the second OR-circuit to the outputs of the fourth, fifth and sixth AND-circuits; a third input of the master clock is connected to the output of the seventh AND-circuit; and the output of said master clock is connected to the second input of the comparison unit.

* * * * *